US006644661B2

(12) United States Patent
Ikeda

(10) Patent No.: US 6,644,661 B2
(45) Date of Patent: Nov. 11, 2003

(54) POST-PRINTING PROCESSOR FOR PRINTER

(75) Inventor: Teruyuki Ikeda, Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/862,599

(22) Filed: May 22, 2001

(65) Prior Publication Data

US 2001/0054790 A1 Dec. 27, 2001

(30) Foreign Application Priority Data

May 30, 2000 (JP) ..... 2000-160715

(51) Int. Cl.[7] ..... B65H 43/00
(52) U.S. Cl. ..... 271/279
(58) Field of Search ..... 271/179, 207, 271/213, 292, 279; 700/219, 223, 224, 225; 221/75

(56) References Cited

U.S. PATENT DOCUMENTS 3,377,929 A * 4/1968 Ware et al. ..... 271/179
5,435,544 A * 7/1995 Mandel ..... 270/58.01
5,480,135 A * 1/1996 Nagane et al. ..... 271/179
5,544,876 A * 8/1996 Ruch ..... 271/179
6,336,630 B1 * 1/2002 Holtman et al. ..... 271/213
6,370,446 B1 * 4/2002 Divine ..... 700/223

* cited by examiner

*Primary Examiner*—Donald P. Walsh
*Assistant Examiner*—Kenneth W Bower
(74) *Attorney, Agent, or Firm*—Dickstein, Shapiro, Morin & Oshinsky, LLP.

(57) ABSTRACT

The present invention aims at providing a post-printing processor in which a user can easily find his/her print job.

Rotary coils 2 are arranged at the sides of a discharging roller 101 of a printer so as to hold sheets of a single print job in a gap between the spiral rotary coils 2. The rotary coils 2 makes a full-turn after every operation of a single print job is completed to elevate the print jobs in respective gaps of the spirals for a pitch. Accordingly, the print jobs are distinctly separated at different pitch levels of the spirals. Even when a print job between other print jobs is removed, the separation between the print jobs is maintained and the other print jobs are not commingled.

5 Claims, 12 Drawing Sheets

POST-PRINTING PROCESSOR FOR PRINTER

FIELD OF THE INVENTION

The present invention relates to an improvement in a post-printing processor for a printer.

BACKGROUND OF THE INVENTION

In a recent business office environment, each person is usually provided with a personal computer that is connected to a plurality of other computers via a network.

One or more printers for printing out the works processed by the personal computers are also incorporated in the network to selectively be used by a plurality of shared users. However, printed jobs from the plurality of shared users are often stacked up together at a discharging port of the printer. Thus, after a printing operation, the user has to walk up to the printer and look for his/her job in a stack of jobs of other users.

Thus, printers used by a plurality of shared users require a post-printing processing for separating the jobs for users to help each user to easily pick up his/her job. This post-printing processing is more strongly demanded as the number of shared users connected to the network becomes larger.

As such a post-printing processing technique, a sorter is known in which a plurality of sheet-discharging ports are assigned to respective users and can automatically be selected by a controller of the printer to prevent jobs of different users from commingling. However, post-printing processing by this type of sorter requires multiple sheet travel paths and a mechanism for switching among the sheet travel paths for guiding jobs to the plurality of discharging ports, which results in a large-scaled device structure. Accordingly, such sorter has problems of a high installation cost as well as an unreasonably limited number of users despite of the expense, and thus is rarely employed.

In view of these problems, the following processes which employ simple mechanisms are known as processes that can be employed at a low cost by multiple users. Hereinafter, conventional post-printing processes that are used in practice will be described together with their problems.

FIG. 11 is a view showing the most major post-printing processor that is used in practice, where a job 200 currently under the process is discharged through a discharging roller 101 in a longitudinal direction and stacked up on already discharged jobs of other users.

The jobs of other users beneath the currently processed job 200 are stacked up in alternating directions such that the first job 201 is in the longitudinal direction, the second job 202 is in the transverse direction, the third job 203 is in the longitudinal direction again and the forth job 204 is in the transverse direction again. This type of sorting is accomplished by providing two sheet cassettes (not shown) for stocking sheets in the longitudinal and transverse directions. A controller of the printer alternately switches between the longitudinal and transverse directions for each job sent from the users via the network.

FIG. 12 is a view showing another exemplary simple sorting mechanism which can be mounted on a printer 100. The small-sized sorter 103 which may be mounted as an option on a sheet discharger 102 of the printer 100 is configured to output jobs while the printer 100 switches between a sheet-conveying path directing to a standard discharging port 104 and a sheet-conveying path directing to the sorter 103. The sorter 103 is provided with a plurality of sheet-discharging ports A, B, . . . N, and an internal conveying path switching mechanism for separating sheets by job. An internal controller of the sorter 103 may look for an empty discharging port to discharge a single job, or the sheet-discharging ports may be assigned to respective users in advance to serve as user-specific discharging ports.

The first conventional method shown in FIG. 11 which alternately switches the sheet discharging directions requires two sheet cassettes for both longitudinal and transverse discharges. A sheet cassette requires a number of machinery components and a large-sized body, for example, for identifying a type of a stack of sheets set in the cassette, for picking a single sheet from the stack of sheets, and for forming a conveying path for the stacked sheets. Accordingly, the sheet cassette is expensive as an option and will increase an installation cost. In addition, when either of the two cassettes is low of paper stock, the printer detects "paper low" signal, which means that the maximum number of sheets that can actually be printed is not so large in spite of the size of the device.

Although each job may be stacked up in alternating directions, the jobs are not always removed in this order. For example, a job in the transverse direction may be picked up first, leaving the adjacent jobs in the longitudinal direction commingled.

The greatest problem here is that the user has to look through the stacked jobs at the printer to find his/her job.

A printer mounted with the sorter shown in FIG. 12 requires a certain strength to bear the weight of the mounted sorter 103 as well as the total weight of the discharged sheets on a small area of the top of the sheet discharger 102. Thus, the printer 100 would cost high to ensure this strength as well as to provide the switching mechanism for conveying sheets in vertical and horizontal directions.

The mechanism for switching among the sheet-discharging ports A through N complicates the configuration of the discharger, increases the cost of the controller and requires a large power source, resulting in an increase of the cost of the sorter 103 itself. Moreover, since the number of the discharging ports is limited due to the mounting-type structure, the discharging ports are likely to become full unless the users come quickly enough to remove their jobs.

Thus, post-printing processor has been considered to have no merit or achievement of being developed at a great cost as an optional device, since this would further raise the price. As a result, despite of their convenience, the above-described post-printing processors have never been popular.

In sum, the conventional post-printing processors are associated with the following problems. First problem is that both of the alternative-direction stacking technique and the simple sorter configuration technique increase the installation cost borne by the user due to the indispensable device structure.

Second problem is that in the case of the alternative-direction stacking technique, the user has to actually look through the jobs discharged from the printer to find his/her job. In the case of the simple sorter configuration technique, the limited number of discharging ports become full in short time, which will interfere with the sorting function.

Thus, the present invention has an objective of providing a post-printing processor which solves the above-described conventional problems, and reduces the installation cost borne by the user and facilitates locating of the desired printed job.

SUMMARY OF THE INVENTION

The present invention is a post-printing processor for a printer, which can process a plurality of print jobs. In view of the above-described problems, the post-printing processor specifically comprises: spiral shape sheet-holding members rotatably arranged to face a sheet-discharging port of the printer such that the center axes of the spiral shape sheet-holding members are generally perpendicular to a sheet conveying plane of the sheet-discharging port; and a rotating mechanism for retaining the rotating positions of the spiral shape sheet-holding members such that openings of the gaps of the spiral shape sheet-holding members face the sheet-discharging port, and for driving the spiral shape sheet-holding members to make one or more full-turns after every single print job is completed.

According to this structure, a sheet sent out from the sheet-discharging port of the printer is inserted into the spiral shape sheet-holding members which are arranged to face the sheet-discharging port. Since the positions of the spiral shape sheet-holding members are retained such that the openings of their gaps face the sheet-discharging port, the spiral shape sheet-holding members do not interfere with the insertion of the sheet. Accordingly, sheets of a single print job are continuously discharged from the sheet-discharging port of the printer, and inserted into and stacked on the gap of the spiral shape sheet-holding members. When the printing operation of the single print job is completed, the rotating mechanism is actuated to drive the spiral shape sheet-holding members to make one or more full-turns. The spiral shape sheet-holding members are driven to make full-turns so that the openings of their gaps return to the positions where they face the sheet-discharging port. For example, the full-turns may be a single full-turn. After the full-turn, the sheets of the single job are elevated for a pitch of the spiral in the axial direction of the spiral shape sheet-holding members. By repeating this operation after every single print job is completed where every print job is sent a pitch downstream in the axial direction of the spiral shape sheet-holding members, the print jobs can be held separate from each other in the gaps of the spiral shape sheet-holding members at respective pitch levels.

Since the print jobs are separated at respective pitch levels, users can easily find and collect his/her print job. There is no need of providing multiple sheet cassettes for switching between the directions of the discharged sheets, and thus the structure of the printer can be simplified. The spiral shape sheet-holding members have simple spiral structure, and thus the post-printing processor can be produced at low cost. The contents of the print jobs in the spiral shape sheet-holding members can easily be confirmed. Even when a print job is removed away from the spiral shape sheet-holding members, the remaining print jobs do not commingle with each other and remain separate from each other.

The jobs left by the users are sent to the downstream end of the spiral shape sheet-holding members, where they are collectively accumulated. This allows successive printing operation until the entire sheet stock is used up. The number of print jobs that can be held separate by the spiral shape sheet-holding members is limited by the number of pitches of the spiral shape sheet-holding members. For example, when the number of the pitches is N and the spiral shape sheet-holding members are driven by the rotating mechanism to make a single full-turn per print job, print jobs for the last N number of operations can distinctly be held separate. Unlike a sorter which can only distribute print jobs into a limited number of sheet-discharging ports, the print jobs processed by the invention can continuously sent downstream of the processor. Thus, the print jobs left by the users do not interfere with operations of new print jobs.

The spiral shape sheet-holding members may be arranged in parallel at the both sides of the sheet-discharging port, and the rotating mechanism may be configured so as to synchronously rotate the spiral shape sheet-holding members.

According to this structure, the sheets sent out from the sheet-discharging port of the printer can be held by two spiral shape sheet-holding members arranged at the sides of the sheet-discharging port, thereby enhancing stability of holding sheets.

When the spiral shape sheet-holding members are arranged in parallel at the both sides of the sheet-discharging port, the spiral shape sheet-holding members are preferably wound in symmetrical directions, and the rotating mechanism is preferably configured so as to synchronously rotate the spiral shape sheet-holding members in symmetrical directions.

By doing so, friction against the sheet sent out from the sheet-discharging port can be compensated in right and left directions, thereby preventing sliding of the discharged sheet in the transverse direction. Another pair of spiral shape sheet-holding members in parallel can also be provided next to the first pair of spiral shape sheet-holding members in the sheet traveling direction. For example, two pairs of spiral shape sheet-holding members can be provided to hold the four corners of sheets sent out from the sheet-discharging port.

Furthermore, for a printer connected to a network, the post-printing processor may further comprise: an identifying information generating member for generating identifying information unique to a print job received by the printer; an identifying information transferring member for transferring the identifying information to a terminal device that has commanded processing of the print job via the network; and a print job holding result displaying member for displaying the relationship between the identifying information for the print job and the gap of the spiral shape sheet-holding members.

By doing so, whenever the printer receives an order of a printing operation, unique identifying information is generated by the identifying information generating member, and sent to the terminal device that has ordered the printing command via the identifying information transferring member and the network. The print job holding result displaying member displays the relationship between the identifying information and the gap of the spiral shape sheet-holding members, that is, the relationship between the identifying information and the held position of the print job corresponding to the identifying information.

Thus, the user can confirm the identifying information for the print job on his/her terminal device, walk up to the printer, and refer to the print job holding result displaying member of the post-printing processor to locate the gap of the spiral shape sheet-holding members holding his/her print job, thereby easily collecting his/her print job.

The print job holding result displaying member may comprise a plurality of display elements arranged in the axial direction of the spiral shape sheet-holding members at intervals of pitches corresponding to the number of full-turns made by the spiral shape sheet-holding members after every completion of a single print job.

For example, when the number of full-turn made after completion of a single print job is one, the display elements are provided at pitch intervals in the axial direction of the spiral shape sheet-holding members. Each of the display element displays the identifying information for the print job held in the corresponding gap.

Thus, the user can refer to the identifying information for the print job on his/her terminal device, and collect his/her print job from the gap corresponding to the display element with that identifying information.

The print job location displaying member may comprise a plurality of identifiable markings arranged in the axial direction of the spiral shape sheet-holding members at intervals of pitches corresponding to the number of full-turns made by the spiral shape sheet-holding members after every completion of a single print job, and identifying information displaying members for displaying the identifying information of the print jobs in correspondence with the respective markings.

According to this structure, fixed markings are provided in the axial direction of the spiral shape sheet-holding members. Based on the markings and the identifying information displayed on the identifying information displaying member, the user can find his/her print job. Specifically, the user can collect his/her print job from the gap provided with the marking corresponding to the identifying information displayed on his/her terminal device. The fixed markings can simply be printed or carved on the body of the post-printing processor. The identifying information displaying member may utilize a liquid crystal display or the like of the printer, which is advantageous in reducing the production cost of the post-printing processor.

Instead of the identifying information, the identifying information displaying member may display the user's name of the terminal device that has ordered the printing operation.

In this case, it is not necessary to transfer the identifying information to the user's terminal device, and thus the identifying information generating member and the identifying information transferring member are not necessary. The user can locate his/her print job in the spiral shape sheet-holding members based on the markings and his/her user's name displayed on the identifying information displaying member. Since this does not require communication of the identifying information via the network, the network traffic jam can be eased.

The post-printing processor may comprise: a plurality of regulating pieces for regulating the fore-end of a sheet sent to the spiral shape sheet-holding members; a regulating piece positioning member for adjusting the positions of the regulating pieces according to the size of the sheet; and a regulating piece driving member for moving each of the regulating pieces in the axial direction of the spiral shape sheet-holding members synchronously with the sheet conveying rate associated with the rotation of the spiral shape sheet-holding members.

According to this structure, the back-ends of the print job sent to the spiral shape sheet-holding members are uniformly aligned regardless of the sizes of the sheets. As a result, even when sheets of different sizes are used for respective print jobs, the print jobs can readily be removed.

The gaps of the spiral shape sheet-holding members are not necessarily equal. For example, the gap immediately adjacent to the sheet-discharging port may be formed to be relatively large.

By making the gap immediately adjacent to the sheet-discharging port (the gap for initially receiving the print job from the printer) larger, the sheets are prevented from being stuck and can smoothly be sent from the printer to the spiral shape sheet-holding members. Since discharged print jobs are held sufficiently far from the discharging port, undesirable interference of the print job with the printer upon removing the print job can be avoided and thus the newest print job can easily be removed. The gaps of the spiral shape sheet-holding members and the regulating pieces travel in a synchronous manner by the regulating piece driving member. Even when a certain pitch is different from others, the positional relationship between the gaps and the regulating pieces may be maintained by making the widths of the regulating pieces large.

DETAILED DESCRIPTION OF THE INVENTION

Figure 1:
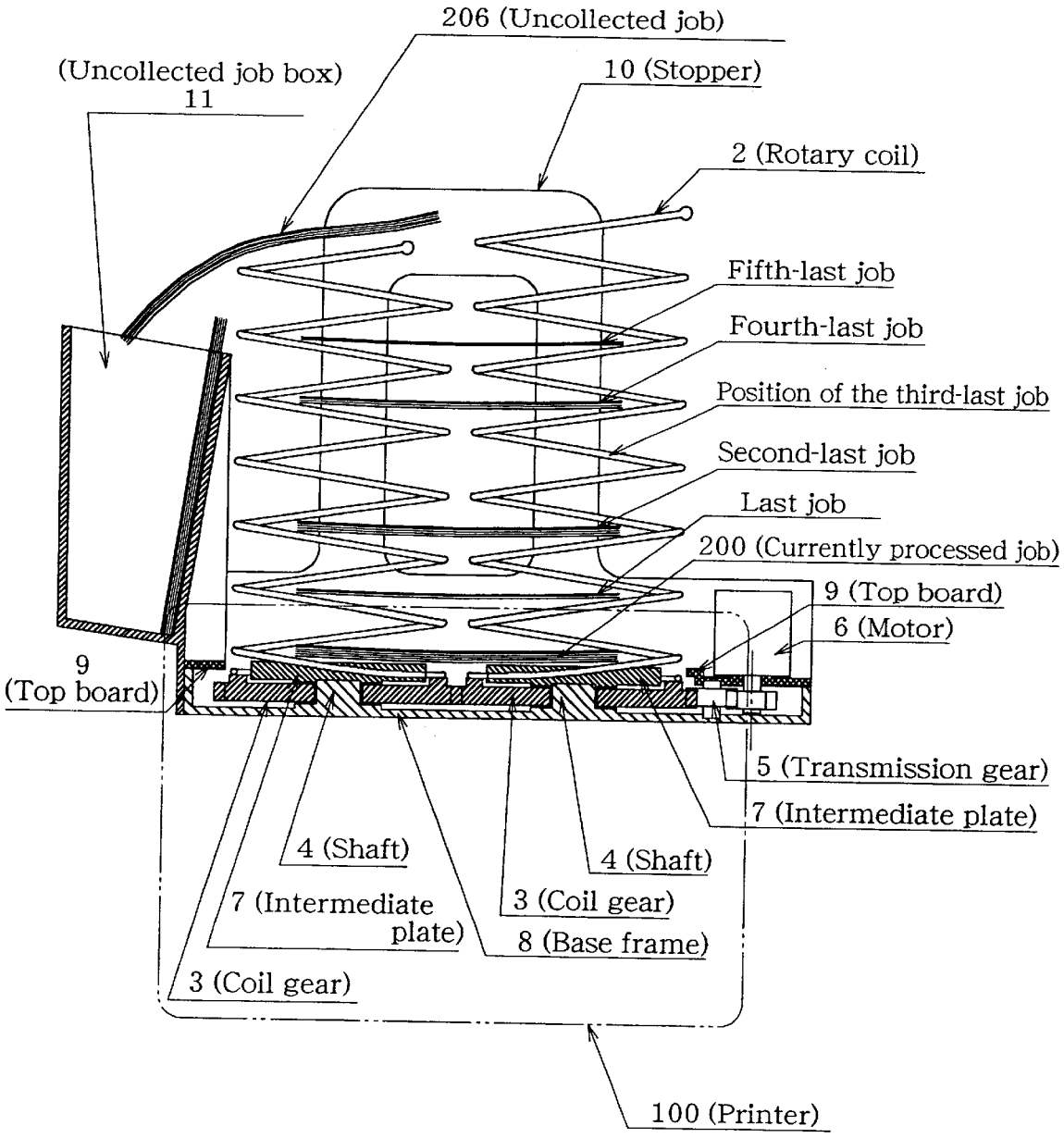
FIG. 1 is a schematic front view of a post-printing processor according to one embodiment of the invention.
Figure 2:
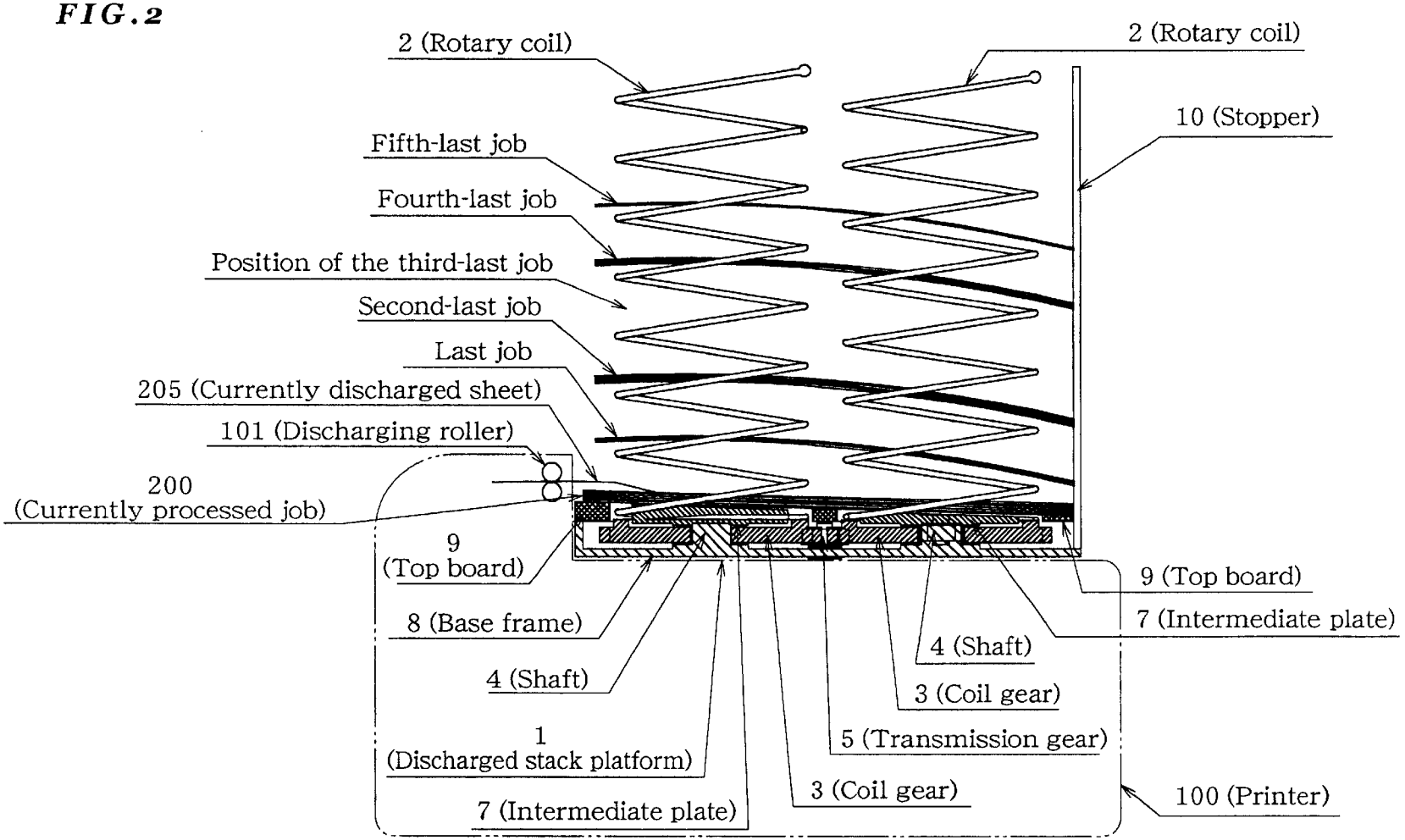
FIG. 2 is a schematic side view of a post-printing processor according to one embodiment of the embodiment.

Hereinafter, an outline of one embodiment of the invention will be described. FIGS. 1 and 2 show a structure of a post-printing processor, respectively seen from the front and side of a printer 100 whose external shape is briefly shown.

Sheets discharged from a discharging roller 101 (FIG. 2) at a discharging port of the printer 100 travels from the front to the back of FIG. 1 (front view), and from left to right in FIG. 2 (side view).

The post-printing processor is exemplarily mounted as an option on a discharged stack platform 1 of the printer 100. Hereinafter, features of this post-printing processor will be described.

First, the post-printing processor is provided with four rotary coils 2 as spiral shape sheet-holding members whose diameters are about two-thirds the transversal length (length perpendicular to the traveling direction) of a discharged sheet. Each pair of rotary coils 2 along the width of the processor are symmetrically wound (e.g., the right coil and the left coil are wound in clockwise and anti-clockwise directions, respectively). Two pairs of such rotary coils 2 are arranged in rows and columns on the printer 100.

One pair of rotary coils 2 are arranged in parallel at the both sides of the discharging roller 101 at the sheet-discharging port while the other pair is arranged in parallel on the sheet-conveying plane downstream from the first pair of coils. The center axes of every rotary coil 2 are perpendicular to the plane of sheets discharged from the discharging roller 101. As shown in FIGS. 1 and 2, the openings of the gaps formed by the rotary coils 2 are adjusted to face the sheet-discharging port, i.e., the discharging roller 101.

The four rotary coils 2 are provided with coil gears 3, shafts 4 for supporting the coil gears 3, a transmission gear 5 and a single motor 6 for driving the coils.

Figure 3:
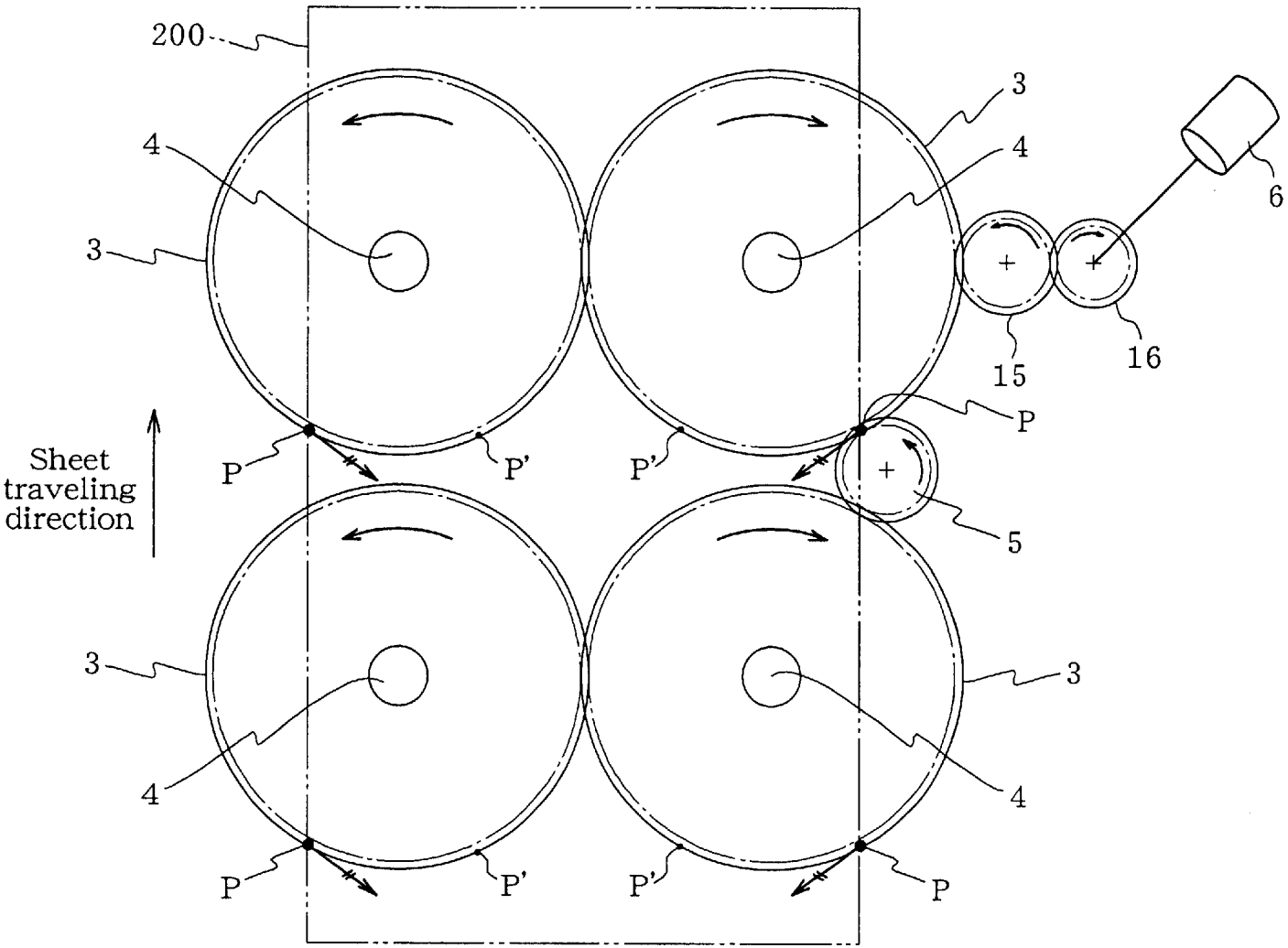
FIG. 3 is a function view showing coupling relationship between gears of the post-printing processor of the embodiment.

The coupling relationship among the gears are shown in FIG. 3. The rotating mechanism of the present embodiment is implemented with the coil gears 3, the shafts 4, the transmission gear 5 and the motor 6. A junction gear 15 is a mechanical element that transmits the rotating force of a pinion 16 driven by the motor 6 to the coil gears 3.

A sheet 205 discharged from the printer 100 is inserted into the bottommost gap of the four rotary coils 2, and stacked up on a currently processed job 200. Disk-shape intermediate plates 7 whose diameters form a small gap with the internal diameters of the coils 2 are un-rotationally fixed on the respective shafts 4 to meet the inclination of a top board 9 on a base frame 8. The intermediate plates 7 are provided so that the discharged sheets are not caught by the notches of the top board 9, which are provided to accommodate the bottom ends of the coils 2.

Rotation of the rotary coils 2 is halted while a single job is discharged. Once a single job is completely discharged, a discharge completed signal (not shown) is sent from the printer 100 to a controller (not shown) in the post-printing processor, whereby the rotary coils 2 make a full-turn.

According to the above-described structure, the right and left pairs of rotary coils 2 rotate in symmetric directions while the fore-end of the discharged sheet is stabled by a stopper 10. Thus, when the rotary coils 2 make a full-turn, the points of contact between the bottommost sheet of the discharged job 200 and the rotary coils 2 are elevated for a pitch of the coils 2 while the positions of the contact points are maintained.

An example of the contact points on the rotary coils 2 is represented as points P in FIG. 3. Since the rotating and wound directions are symmetrical for the right and left pairs of coils 2, the friction of the rotary coils 2 against the bottommost page of the discharged job 200 at the contact points P is compensated in the right and left directions, thereby preventing sliding of the discharged job 200 in the transverse direction. Referring to FIGS. 1 and 3, the right and left sides of the bottommost page of the discharged job 200 are in contact with the coils 2 outside the center axes of the coils 2. In fact, since the print job 200 is deflected down by its own weight as shown in FIG. 1, the job 200 and the coils 2 will form contact arcs P–P' as shown in FIG. 3. Therefore, even when the bottommost page of the job 200 is in contact with the coils 2 outside the center axes of the coils 2, no reverse force in an anti-sheet-traveling direction is applied to the bottommost page.

By repeating the above-described operation, the discharged jobs will be kept apart at different pitch levels as shown in FIGS. 1 and 2 where earlier jobs are stacked at higher pitch levels, e.g., the last job immediately before the currently-processed job 200 is held at a pitch above the job 200 and the second-last job is held two pitches above the job 200.

Each discharged job can easily be removed from the front side of the printer 100. When a user removes a job, the gap holding that job (e.g., the third-bottom gap) becomes empty as shown in FIGS. 1 and 2.

If a user leaves the ordered job, the job continues to be sent a pitch downstream after every single job is completed. For example, in FIGS. 1 and 2, after six operations, a job reaches the downstream end (i.e., the top end) of the rotary coils 2.

If the user still leaves the ordered job yet after six operations, the uncollected job 206 at the top of the coils 2 is deposited in an uncollected job box 11 by the rotation of the rotary coils 2 and by arranging the four rotary coils 2 such that the heights of the coils 2 are different between the right and left pairs.

Figure 4:
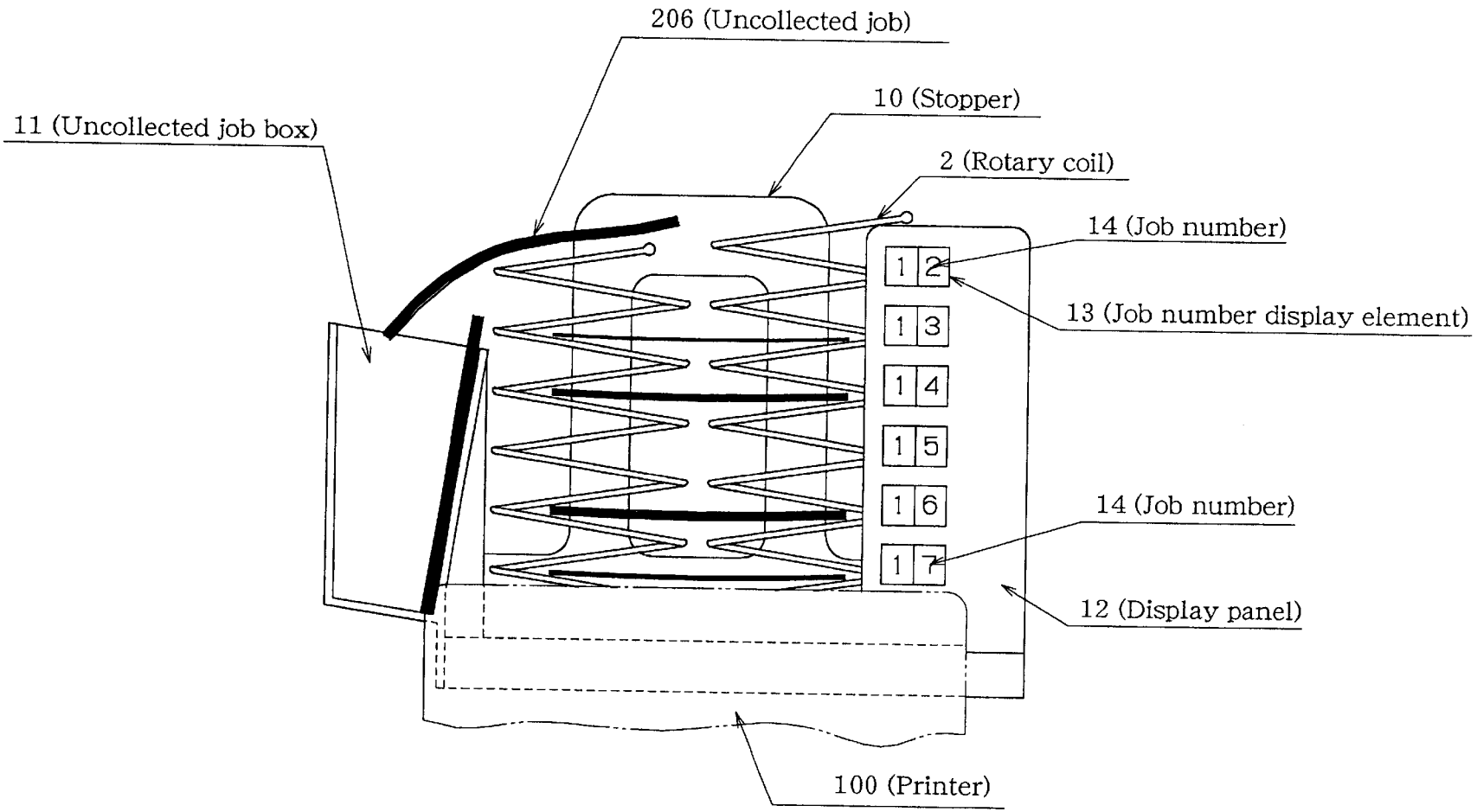
FIG. 4 is a schematic front view of the post-printing processor of the embodiment, which is provided with a display panel.

FIG. 4 shows the structure described with reference to FIGS. 1 and 2, seen from the front side of the printer 100, which is further provided with a display panel 12 that is necessary upon actual use.

The display panel 12 is integrally formed on the base frame 8 and extends in the axial direction of the rotary coils 2. The display panel 12 is provided with job number display elements 13 corresponding to respective gaps of the rotary coils 2 (or the spiral shape sheet-holding members). The job number display elements 13 display two-digit numbers, or job numbers 14, as identifying information.

A controller (not shown) of the printer 100 is programmed to notify a terminal device of a user who has ordered the printing operation that the printing has been completed as well as of the job number via the network. Therefore, the user can walk up to the printer 100, locate the job by finding the job number display element 13 displaying the notified job number, and simply collecting the print job held at the position corresponding to that job number display element 13. The job number display elements 13 are the major components of a print job location displaying member.

In the case where the user leaves his/her job at the printer 100 for a while and comes to the printer 100 to collect the job after the job has been deposited in the uncollected job box 11, the user can tell that (s)he needs to look in the uncollected job box 11 since the notified job number is no longer displayed on the job number display elements 13.

According to the above-described structure, even when a plurality of shared users connected to the network order printing operations, each job can be held separate at different position by the rotation of the coils 2 for each job. The job number is notified to the user via the network upon the completion of the job, which aids easy locating of the job. As a result, the user can easily find and collect his/her job.

To process the printing commands sent from a plurality of users to the print server in due order, and to send the printer status information (e.g., sheet availability, toner availability and status of the printing operation) from the printer 100 to the users' terminals are already known in the art of network-based two-way communication, and thus the detailed descriptions thereof are omitted herein.

Since the post-printing processor is intended as an optional device that can be mounted on the printer afterwards, the printer 100 needs to be provided with an interface for actuating the optional post-printing processor.

Although the rotary coils 2 stand exposed in FIGS. 1 and 2, the post-printing processor in practice is provided with an exterior cover for design consideration. The exterior cover or the like is not shown in the figures since it is not directly relative to the intension of the present invention. The interface necessary for the printer 100 to send a discharge completed signal after completion of a single job to the post-printing processor or for the post-printing processor to send a signal to the printer 100 to wait while the processor is under an operation is also not shown in the figures. In addition, detailed descriptions of the motor 6 for driving the rotary coils 2 and a control algorithm for managing or displaying the job numbers 14 are also omitted for they are simply a matter of design.

Hereinafter, an operation of the post-printing processor according to the present embodiment will be described in detail with reference to FIGS. 1 to 4.

Herein, the operation starts from a state where a number of jobs have already been completed and the discharged jobs are left in the second-, third-, fifth- and sixth-bottom gaps and the job in the fourth-bottom gap has already been removed by the user as shown in FIGS. 1 and 2.

When a user connected to the network commands a printing operation, the print data is sent to the print server (not shown) via the network (not shown). Once the print server receives the print data, it confirms the availability of the printer 100 (i.e., that the former job is completed and the rotary coils 2 have made a full-turn to elevate that former discharged job to the second-bottom position), and gives the print data to the printer 100.

Once the printer 100 receives the print data, it executes the printing operation in a designated page order while the printed sheets are discharged from the discharging roller 101 in the bottommost gap of the spiral coils 2 of the post-printing processor as shown in FIG. 2. Since the rotary coils 2 are resting during this discharging process of a single job, the sheets discharged from the printer 100 are stacked up in order as the job 200.

When a single job is completely discharged from the printer 100, the controller (not shown) in the printer 100 outputs a discharge completed signal to the post-printing processor via the interface (not shown). Once the post-printing processor receives the discharge completed signal, a controller (not shown) of the post-printing processor returns a signal to the controller of the printer 100 to make the printer 100 wait until the next print job operation begins.

Next, the controller (not shown) of the post-printing processor, while monitoring a photosensor (not shown), drives the motor 6 such that the coil gears 3 make a single full-turn.

By driving the coil gears 3 to make a single full-turn, the rotary coils 2 fixed to the coil gears 3 also make a full-turn. The rotating directions of the right and left pairs of rotary coils 2 are opposite due to their symmetric wound directions, and the fore-end of the discharged sheets are stabled by the stopper 10. Accordingly, a single full-turn of the rotary coils 2 elevates the contact arcs between the bottom page of the discharged job and the coils 2 for one pitch of the coils 2.

At the same time, the full-turn of the rotary coils 2 elevates the job in the second-bottom gap to the third-bottom gap, and the job in the third-bottom gap to the fourth-bottom gap. According to the present embodiment, the job in the seventh-bottom gap is elevated to the top of the coils 2. Since the heights of the right and left pairs of coils 2 are made different, the job at the top slides and falls into the uncollected job box 11 due to the height difference and the rotation of the coils 2.

Once the rotary coils 2 complete the single full-turn, the discharged job is in the second-bottom gap where it is higher than the top cover of the discharger of the printer 100. Thus, the job can easily be found and removed from the front of the printer 100.

While the discharged job elevates to the second-bottom position, the controller (not shown) of the post-printing processor stops sending the waiting signal to the controller (not shown) of the printer 100 via the interface (not shown).

The current job number set at a counter (which retains the information even when the power of the controller of the post-printer processor is turned off) is incremented and displayed as a new number (in this example, "17") on the bottommost job number display element 13 shown in FIG. 4. The job numbers already displayed before the single full-turn of the rotary coils 2 are shifted to the immediately above job number display elements 13. At the same time, the incremented job number (in this example, "17") is given to the controller of the printer 100. The controller of the post-printing processor executing this process substantially serves as an identifying information generating member.

By being released from the waiting state and by receiving the job number from the post-printing processor, the controller of the printer 100 recognizes that the processing by the post-printing processor has been completed and sends, from the printer server via the network, the job number to the user who has commanded the operation of the job in the second-bottom gap, whereby a message such as "Printing is complete, discharged job number is XX" appears on the screen of the user's personal computer (in this example, "XX" is 17 as shown in FIG. 4). The controller of the post-printing processor executing this process substantially serves as an identifying information transferring member.

Upon receiving the job number notice, the user is informed that the job has completely been discharged. By learning this job number, the user can walk up to the printer 100 and easily locate and collect his/her job by referring to the job number displayed as shown in FIG. 4.

The next job may be executed soon after the job number is given to the operator of the completely discharged job via the network. A number of subsequent jobs may be processed and completed thereafter, but the job number sent to the user does not change and every time a new job is processed, the job numbers 14 on the job number display elements 13 are shifted, in a similar manner to a shift resister, to the immediately above display elements 13 synchronously with the elevation of the positions of the jobs. Thus, whenever the user comes to the printer, the user's job is held at the position assigned with the job number given to the user.

When the user leaves his/her print job at the printer while subsequent jobs are executed, the job will reach the top of the rotary coils 2 and deposited in the uncollected job box 11. In this case, the user will directly look for his/her job in the uncollected job box 11 since the job number given to the user no longer exists on the job number display elements 13.

Since the post-printing processor of the present embodiment distinctly tells the job number and the position of the job via the network to the user who has ordered the print job, the user can easily locate his/her job at the printer 100 by finding the job number display element 13 on the display panel 12 indicating the notified job number. As a result, the user can easily collect his/her job.

The job number is managed by the controller of the post-printing processor and given to the user via the controller of the printer 100 in the operation of the above-described embodiment. Alternatively, the job number may be managed by the controller of the printer 100 and given to the post-printing processor and the user.

The managed job numbers become useless in the uncollected job box 11. In the embodiment shown in FIG. 4, the displayed job numbers are two-digit numbers. Two-digit numbers sufficiently serves as unique identifying information even when a number of jobs are deposited in the uncollected job box 11. For example, the job numbers may be sequentially assigned from the minimum number "01" to the maximum two-digit number "99" and then returns to "01", in which case there is no overlapping is caused between a job number of a job displayed on the job number display element 13 and a job number of a job deposited in the uncollected job box 11. Thus, the user can retain his/her unique identifying information without overlapping with that of others.

According to the above-described embodiment, the rotation of the rotary coils 2 elevates every print job in a separated manner. Therefore, the post-printing processor does not require a particular mounting space other than a space for the printer 100.

Since the discharged print jobs are held on the respective contact arcs of the rotary coils 2 at constant pitches, the print jobs can distinctly be separated and assigned with job numbers, which are given to respective users who have ordered the printing operations. Thus, the user can easily locate his/her job at the printer 100 based on the display of the job number display element 13.

Thus, it is no longer necessary for the users to look through the printed pages to find his/her job.

Moreover, jobs of a plurality of users can be separated by providing the printer 100 with only one cassette, and there is no need of preparing sheet cassettes in longitudinal and transverse directions. Therefore, waste of preparing two cassettes for paper of the same size, and frequent print suspension caused by a paper low state of either cassette can be eliminated.

The post-printing device only requires the four simple coil springs 2, the gears 3, 5, 15 and the motor 6 for driving the coil springs 2, the base frame 8 for assembling these members, and the controller for controlling these members. Thus, the production cost can be reduced, while significant advantage can be obtained regarding the installation cost.

The jobs are pitch-wisely elevated by the full-turn of the rotary coils 2 after every single print job is completed and jobs reaching the top are automatically deposited in the uncollected job box 11. Thus, unlike the conventional sorter-type devices, jobs that remain neglected for a while do not interfere with the printing operation of new jobs.

There is no need of switching among several sheet conveying paths, and the printer 100 only needs an electric interface for connecting with the post-printing processor and a discharger whose height corresponds to the thickness of the gears, i.e., to the height of the bottommost gap of the rotary coils 2.

In general, the printer 100 has a discharged stack capacity of about 250 sheets. Even when the post-printing processor is directly mounted on the discharged stack platform, the thickness of the gears of the post-printing processor does not exceed the thickness of 250 sheets. Since the post-printing processor can be directly mounted on a conventional printer, there is no need to bear costs relating to design alteration of the printer 100. As described above, the cost of the post-printing processor itself can be low. Thus, the post-printing processor can be combined with the printer 100 at an overwhelmingly low cost for the users compared to conventional sorters.

Hereinafter, an another embodiment basically having the same structure as the above-described embodiment but associated with a further devised job guidance technique will be described with reference to FIGS. 5A and 5B. Instead of the display elements 13 (the print job holding result displaying member), this embodiment employs markings on the display panel 12 and liquid crystal display elements 17 as an identifying information displaying member.

Figure 5A:
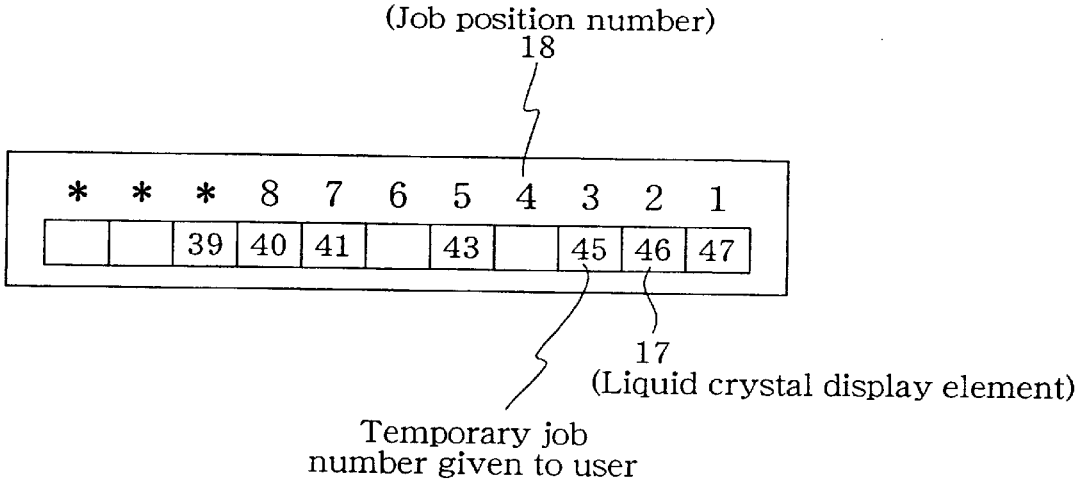
FIG. 5A is a general view of an exemplary identifying information displaying members for displaying job numbers in correspondence with the job position number.

FIG. 5A is a general view of the liquid crystal display elements 17 as an exemplary identifying information displaying member. Each liquid crystal display element 17 displays a user-notified job number 14 in correspondence with a job position number 18. In this case, the display panel 12 is not provided with job number display elements 13 (FIG. 4), but with printed or carved numbers or the like as markings. In the case of FIG. 5A, job position numbers 18 1, 2, 3, 4, 5, 6, . . . are formed as the markings from the bottommost position on the display panel shown in FIG. 4 in place of the job number display elements 13.

On the other hand, the job position numbers 18 shown in FIG. 5A may also be printed or carved, or the liquid crystal display elements 17 can be made larger to display the fixed job position numbers 18 within their display regions.

The liquid crystal display elements 17 may be incorporated into the post-printing processor. Alternatively, a two-row sixteen-digit liquid crystal display element provided on the printer 100 may be utilized for cost down to display the liquid crystal display elements 17 by switching modes on an operation panel.

In this case, the user who has ordered a printing operation is notified of the job number via the network as described above. First, the user will look for the liquid crystal display element 17 indicating the given job number as shown in FIG. 5A (which is incorporated into either the post-printing processor or the printer 100), and find a job position number 18 corresponding to the given job number. For example, if the given job number is "46", the job position number 18 is "2" in the case of FIG. 5A. Next, the user will refer to the display panel 12 to find the printed or carved marking "2", and collects his/her print job from the gap of the rotary coils 2 corresponding to the position of this marking.

The print data sent to the server via the network may include a user's name. As shown in FIG. 5B, a liquid crystal display element 20 may be provided on either the post-printing processor or the printer 100 as an identifying information displaying member for displaying an user's name 19 who has ordered the job in correspondence with the job position number 18. In this case, it is not necessary to notify the job number to the user and may simply display a message "Printing is complete".

When the job is identified by the user's name, it is not necessary to inform the user of the job number along with the printing complete message, and thus this notifying process itself may be omitted. Since the user knows his/her own user's name and knows when (s)he has ordered a printing operation, (s)he can wait for a certain period of time and then walk up to the printer 100 to find his/her print job. This would be advantageous in solving the network traffic jam.

Whether to display the job number or the user's name can be determined depending upon affordability and convenience of the users. The displaying manner is not limited as long as it distinctly tells the user the location of the job.

For example, each job holding position may simply be provided with an LED lamp, so that the user can walk up to the printer and enter the given job number by ten-key such as a membrane switch to turn on the LED lamp corresponding to the position of the job of the entered job number.

Figure 5B:
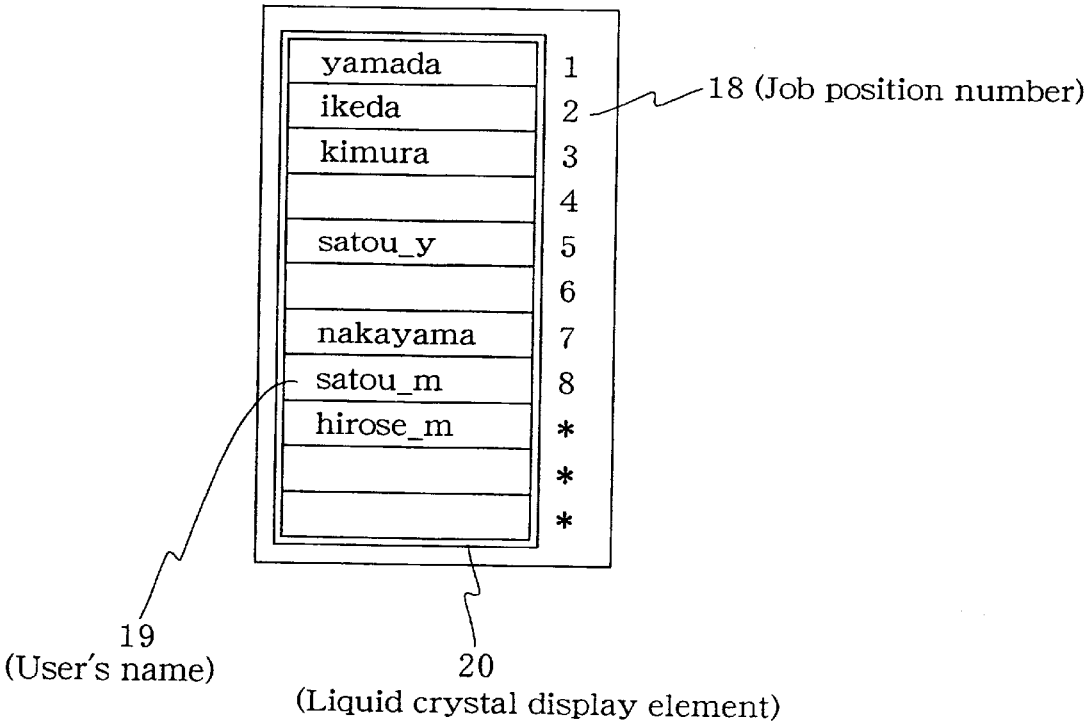
FIG. 5B is a general view of an exemplary identifying information displaying members for displaying user's names in correspondence with the job position number.

In FIGS. 5A and 5B, some job numbers or some user's names are missing. A sensor for detecting the presence of the job at each job holding position may be provided to add a function of turning off the job number displaying member or the display of the user's name corresponding to the position of the removed job. This would allow the user to easily see the non-consecutive job locations occurring from removal of some jobs.

As described above, by modifying the fashion of displaying the job numbers and utilizing the operation panel of the printer 100 as the identifying information displaying member (as the liquid crystal elements 17 or 20), the cost of the post-printing processor can greatly be reduced, earning a maximum cost performance that has never been realized.

According to the embodiment described with reference to FIGS. 1 to 4, the jobs are separated from others by driving the rotary coils 2 to make a full-turn for each job to elevate the jobs for a pitch while stabling the fore-end of the discharged sheets with the stopper 10. According to this embodiment, the size of the sheets is limited to a single size.

Figure 6:
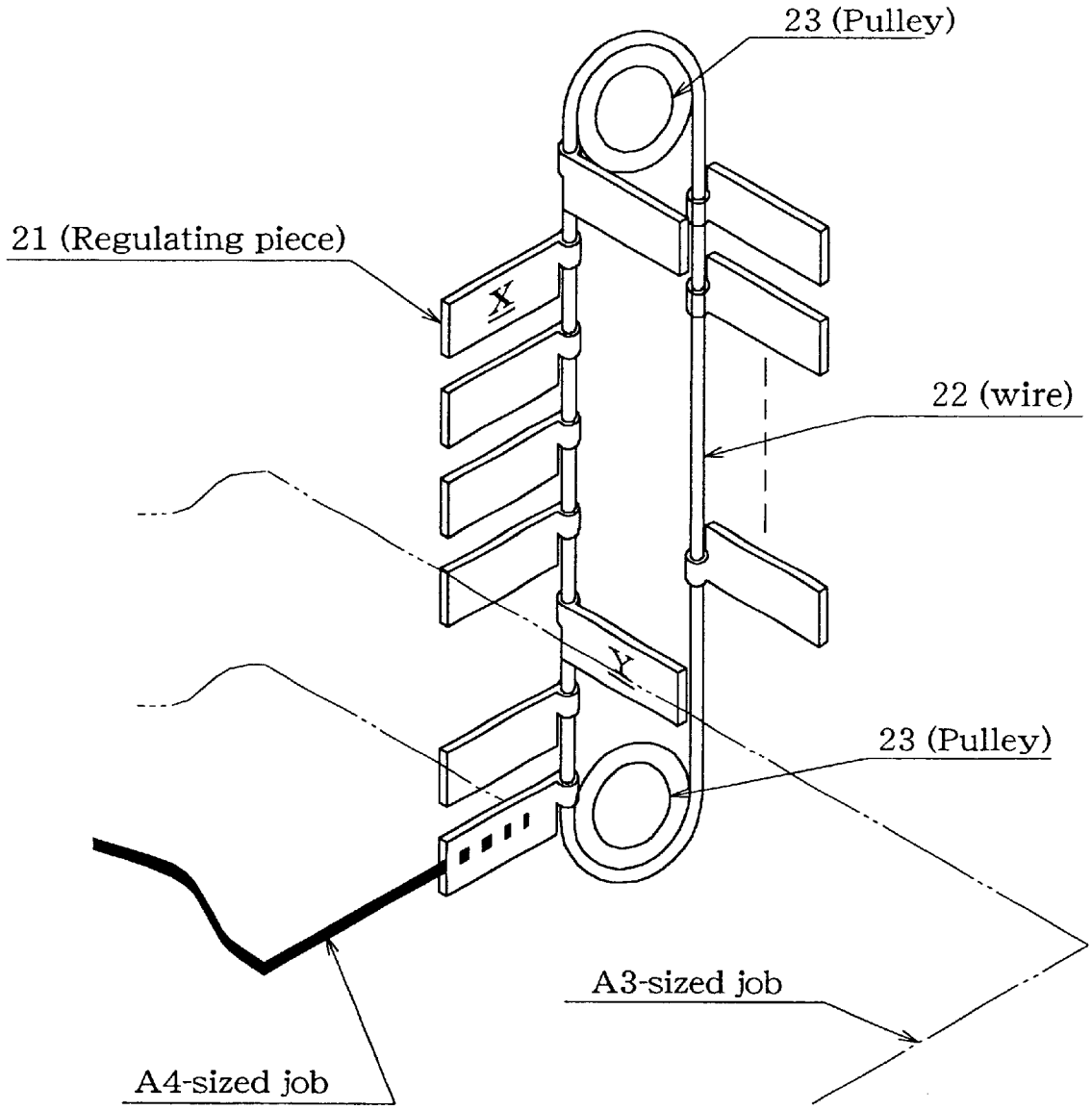
FIG. 6 is a perspective view showing a general structure of a gate mechanism for generalizing available paper sizes.

In order to solve such limitation of the paper size, a gate mechanism shown in FIG. 6 is further provided.

FIG. 6 is a view showing a fore-end of a discharged sheet and the gate mechanism, where the rotary coils 2 are not shown. First, the structure of the gate mechanism will be described, followed by the operation thereof.

First, the gate mechanism is provided with a plurality of separate regulating pieces 21 at heights corresponding to every job holding positions of the rotary coils 2 (not shown). The regulating pieces 21 are supported by an endless wire 22 (or a belt, etc.) between upper and lower pulleys 23 to travel from the bottommost discharge position to the top job holding position of the coils 2 (not shown) in correspondence with the rotation of the coils 2 upon completion of each print job. The endless wire 22 and the pulleys 23 partially constitute a regulating piece driving member.

Each of the regulating pieces 21 supported between the upper and lower pulleys 23 is provided with a mechanism (a regulating piece positioning member) (not shown in detail) which can support the regulating piece 21 in an upright state extending along the width of the discharged sheet (X state in FIG. 6) and in a set back state extending along the discharging direction of the sheet (Y state in FIG. 6). The states of the regulating pieces 21 are set by using an actuator such as a solenoid (not shown) at the bottommost discharge position. Upon passing the top job holding position, the regulating piece 21 returns back to the set back state to extend along the sheet discharging direction.

The regulating pieces 21, the regulating piece positioning members and the regulating piece driving member are also arranged at the opposite side with respect to the transverse direction of the discharged sheets. These members also move synchronously with the rotation of the coils 2 for each job. The regulating pieces 21 can be circulated by the motor 6 for rotating the coils 2.

The post-printing processor configured as described above does not limit the size of the discharged sheets. For example, the controller of the printer 100 may inform the post-printing processor the size of the sheet to be discharged next, whereby the state of the regulating piece 21 is adjusted by the regulating piece positioning member including the actuator such as a solenoid (not shown) at the bottommost discharging position. When A4-sized sheets are to be discharged, the regulating piece 21 is set to the upright state (X state in FIG. 6) to hold the fore-end of the discharged sheets. When A3-sized sheets are to be discharged, the regulating piece 21 is set to the set back state (Y state in FIG. 6) so that a part of the sheet may be held beyond the regulating piece 21. The fore-end of the A3-sized sheet held beyond the regulating piece 21 may be stabled, for example, by the stopper 10 as shown in FIG. 1 or 2.

Thus, the post-printing processor can fully enjoy the functions of the printer 100 without limiting the discharged sheets to A4-sized paper.

Even when A4- and A3-sized jobs are randomly discharged, each job is completely separated from other jobs at different pitch levels of the rotary coils 2, and the back-ends of every job are uniformly aligned since the fore-ends of each job are properly arranged by the regulating operation with the regulating pieces 21. Therefore, either A4- or A3-sized job can easily be removed from the front of the printer 100, solving the conventional problem of an A3-sized job hiding an underlying job.

According to the embodiment described with reference to FIGS. 1 and 2, the pitches of the spiral rotary coils 2 are equal through a whole length. Alternatively, the pitch at the discharged sheet receiving position (i.e., the pitch next to the sheet-discharging port) may be made wider than the pitches at higher job holding positions.

By employing this structure, the sheets are effectively prevented from being stuck and can smoothly be sent from the printer 100 to the post-printing processor. Since a discharged print job is elevated to a sufficiently higher position after a full-turn of the rotary coils 2, a problem of undesirable interference with the top cover of the printer 100 upon removing the print job can be avoided.

Strictly speaking of the above-described case where a specific pitch differs from other pitches, when the regulating pieces 21 travel upward synchronously with the elevation of the jobs as shown in FIG. 6, the positional relationship between the job holding positions of the rotary coils 2 and the regulating pieces 21 may be disordered. However, this can be dealt with by designing the width of the regulation pieces 21 larger.

The full-turn of the rotary coils 2 per job is not limited to a single full-turn and two or more full-turns may be made per job so that the job holding positions are arranged at intervals of two or more pitches.

According to the embodiment shown in FIGS. 1 and 2, a job left by the user is elevated to the top of the post-printing processor and forced to fall in the uncollected job box 11. Alternatively, jobs 207 left by the users can be accumulated at the top of the post-printing processor as shown in FIGS. 7 and 8 by surrounding the jobs 207 with top-end job support frame 24 and top-end side guides 25 which moves up and down according to the movement of the rotary coils 2.

The top-end side guides 25 are plates slidable in up and down directions inside the top-end job support frame 24, which move up by being pushed up by the underlying rotary coils 2 and come down by their own weights.

Figure 7:
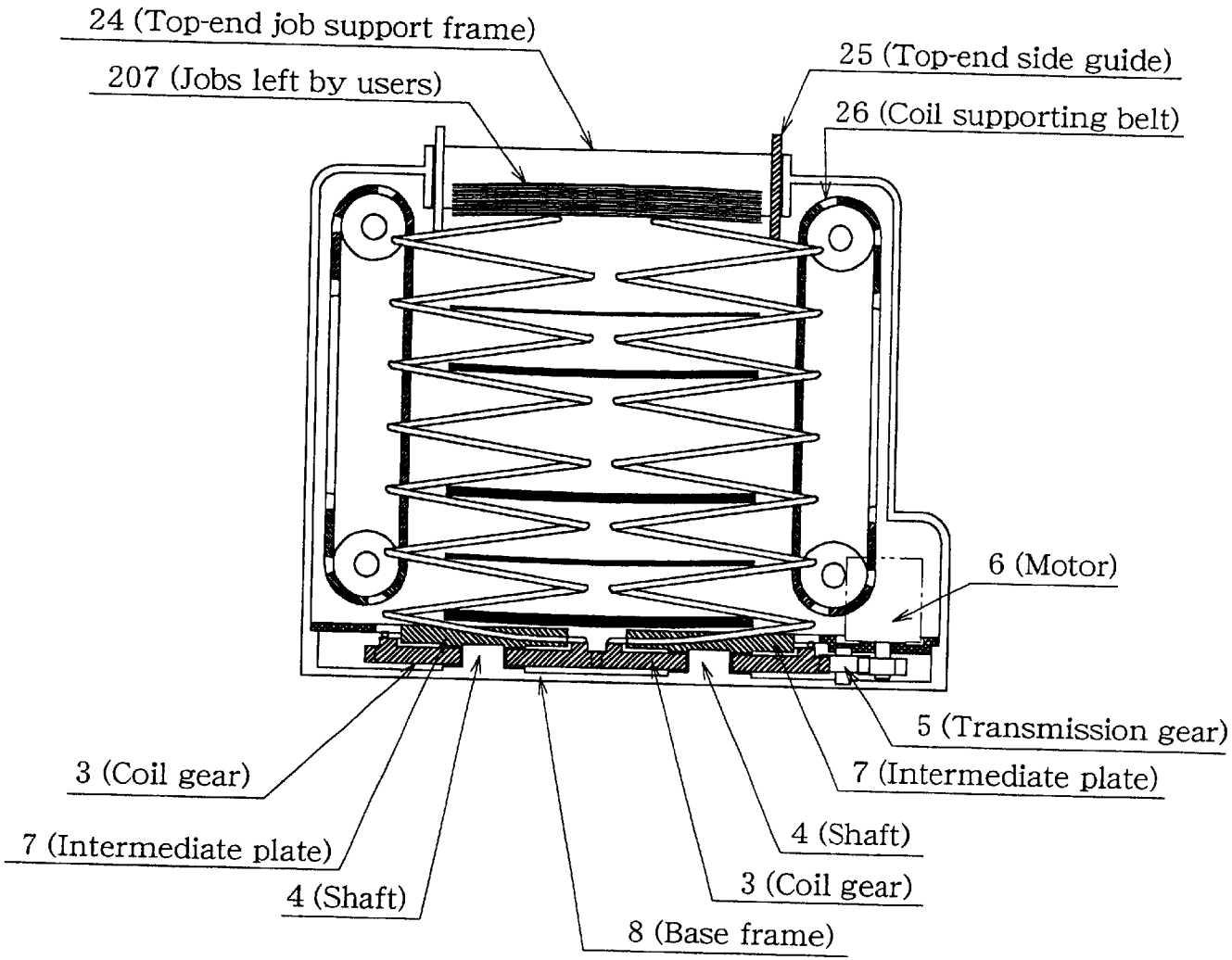
FIG. 7 is a front view of the post-printing processor for showing attachment of a coil supporting belt for preventing deformation of the rotary coils.
Figure 8:
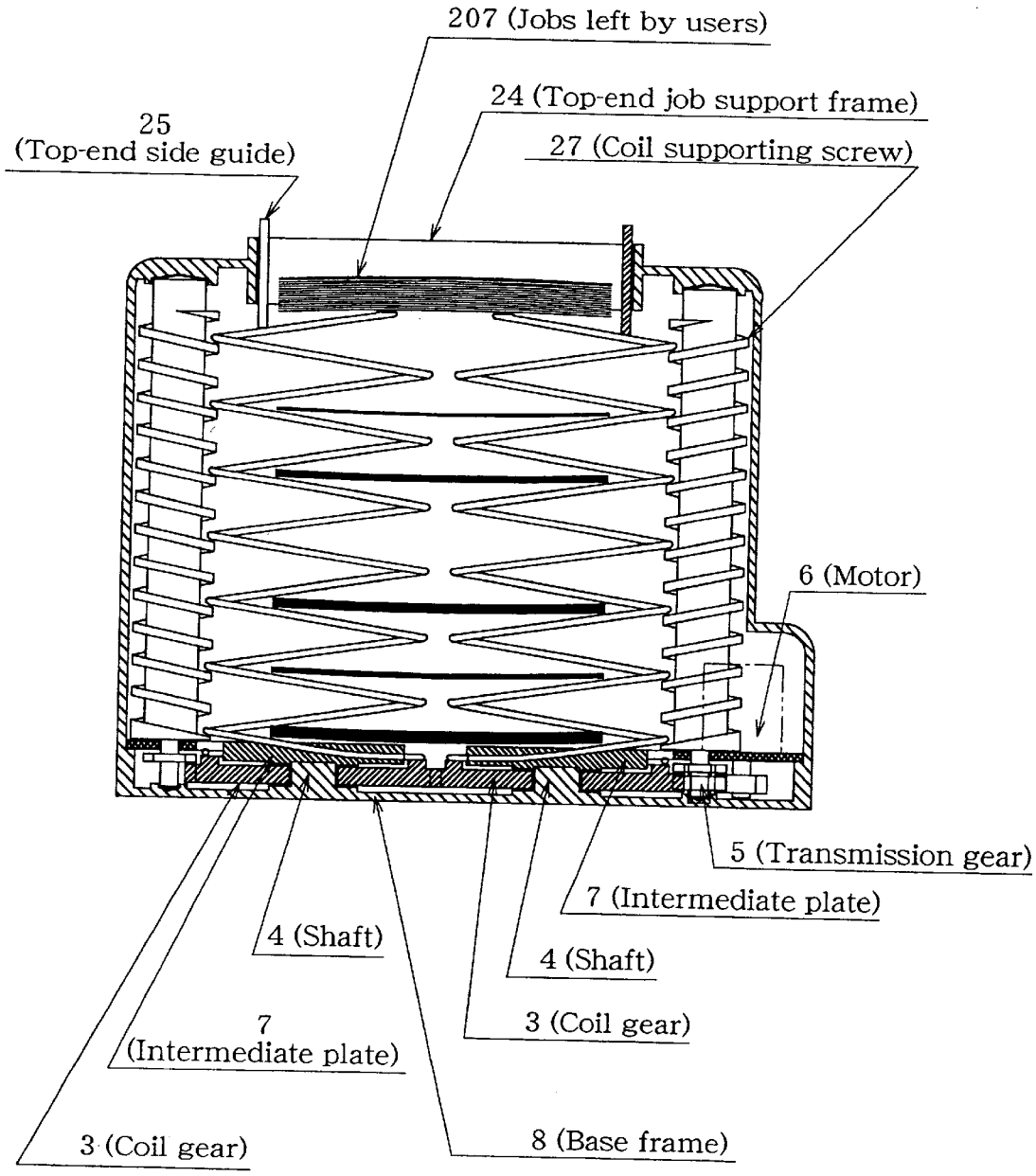
FIG. 8 is a front view of the post-printing processor for showing attachment of coil supporting screws for preventing deformation of the rotary coils.

Alternatively, a coil supporting belt 26 shown in FIG. 7 or coil supporting screws 27 shown in FIG. 8 may be provided on both sides of the rotary coils 2 to rotate with the rotation of the rotary coils 2, thereby reinforcing and preventing the whole rotary coils 2 from deforming by the weight of the jobs.

Furthermore, a weight limiting sensor for detecting the weight put on the coil gears 3 may be provided to prohibit driving of the motor 6 when the weight put on the coil gears 3 exceeds a predetermined weight. Alternatively, the top-end job support frame 24 may be provided with a sensor for detecting a height of the stacked sheets to prohibit driving of the motor 6 when the height of the stacked sheets exceeds a predetermined height. Thus, overload on the motor 6 can be prevented.

According to each of the above-described embodiments, four rotary coils 2 are placed for holding the jobs. When the printer is specialized to jobs of a specific paper size (e.g., A4-sized sheets), the number of the rotary coils may be reduced to two or one by making the diameter of the coils larger, by intentionally inclining the coils, or by providing an auxiliary support member in the vicinity of the coils.

Moreover, the rotary coils may be made of a spring material for a size-specialized printer so that the entire coils can be bent to hold the horizontally discharged jobs in a fan-like arrangement or in a vertical direction.

According to the example shown in FIGS. 1 and 2, the wound directions of the right and left rotary coils 2 are made opposite to each other. However, even if the wound directions of the right and left rotary coils 2 are the same, the job can be held and the same advantage can be obtained by appropriately adjusting the heights of the contact arcs of the right and left coils 2 (i.e., the phases of the coils 2 with respect to the respective coil gears 3) so that the contact arcs are inclined to each other, and by modifying the intermediate plates 7 as traveling guides for the sheets discharged at the bottommost position.

In the example shown in FIGS. 1 and 2, the open ends of the rotary coils 2 have ball-shaped points as can be appreciated from the figures. These are provided to prevent the bottom page of the stacked sheets from being defected at the top position of the coils 2. An anti-friction treatment of the surface of the rotary coils 2 may also be advantageous to prevent damage of the printed face.

The rotary coils 2 may seem to be made from a metal (e.g., coil springs) but they are not limited thereto. They may be molded from a resin. Moreover, their cross-section is not limited to a round shape. For example, the rotary coils 2 may be plastic mold plates with appropriate edges, or molded resins inserted with metal reinforcement coils or the like.

Hereinafter, actual dimensions of the above-described post-printing processor will be described with reference to FIG. 9 as an example.

Figure 9:
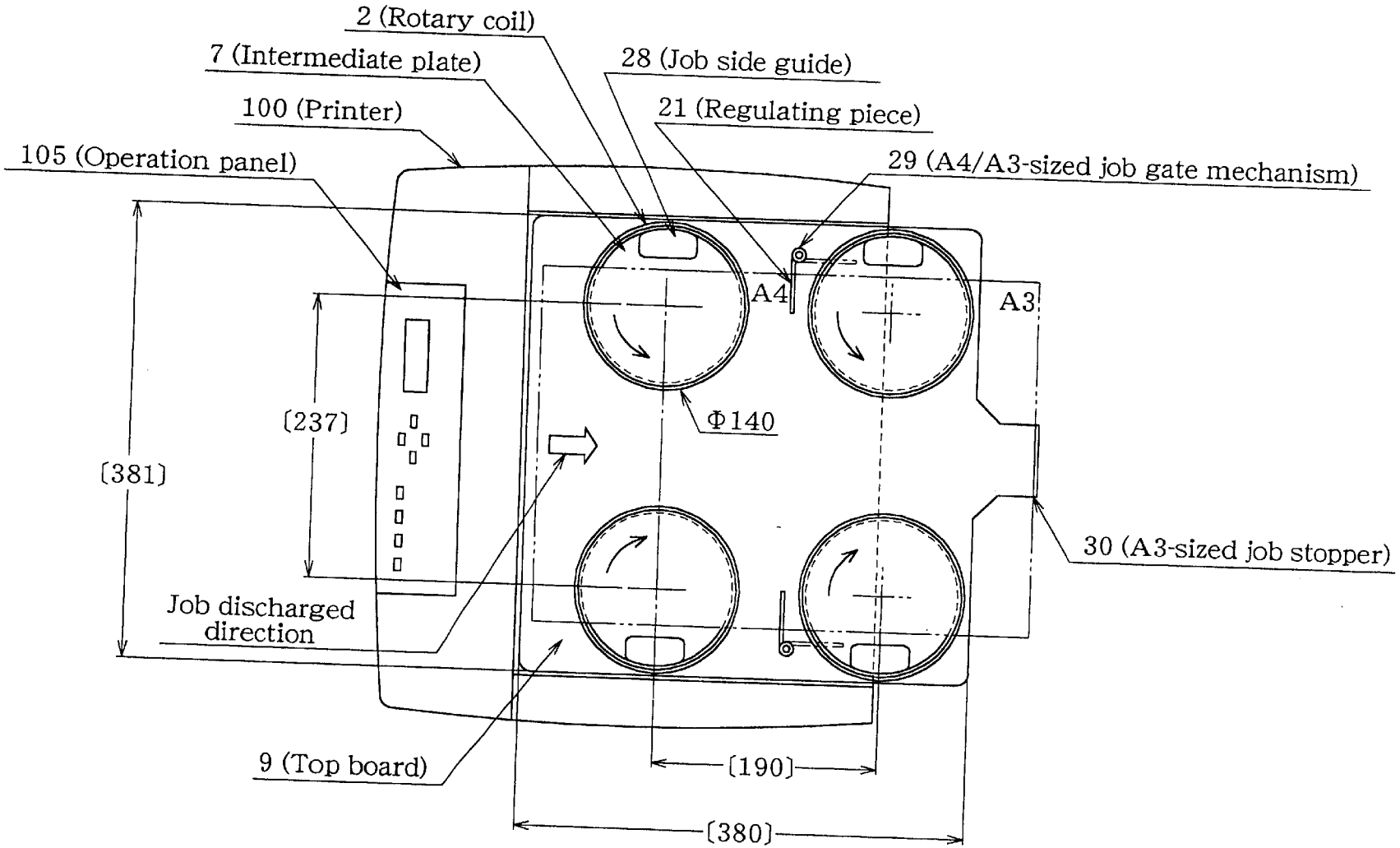
FIG. 9 is a plan view showing general dimensions of the printer provided with the post-printing processor.

FIG. 9 is a plan view of the printer 100 mounted with the post-printing processor. The left side of the figure with an operation panel 105 is the front side of the printer 100 and jobs are discharged from left to right as represented by an open arrow in the figure.

As can be appreciated from the figure, four rotary coils 2 are standing, intermediate plates 7 are arranged at the bottommost job inserting position of the rotary coils 2 to help traveling of the sheets, and job side guides 28 with coil supporting screws are vertically provided to hold the coils as described with reference to FIG. 8 (whereas the coil supporting screws shown in FIG. 8 support the coils from outside, the coil supporting screws 28 shown in FIG. 9 support the coils from inside).

The dimensions of the four rotary coils 2 and the additional members are indicated within brackets ("[ ]"). The distances between the center axes of the adjacent coils 2 are 237 mm in the width direction of the sheets and 190 mm in the discharging direction of the sheets.

The A4/A3-sized job gate mechanism 29 described above with reference to FIG. 6 is provided to comply with both A4- and A3-sized jobs so that, for an A4-sized job, the regulating piece 21 comes out in front to hold the fore-ends of the A4-sized sheet. The fore-ends of an A3-sized job are stabled by the stopper 30. Thus, the back-ends (left ends in the figure) of both A4- or A3-sized job can be aligned in a uniform manner.

The gears (not shown) for turning the rotary coils 2 in directions represented by arrows are arranged beneath the top plate 9, coupled to multiple gears or in combination with a belt, and are arranged in a different manner from the directly-coupled coil gears under the coils described in the embodiment with reference to FIGS. 1 and 2.

Figure 10:
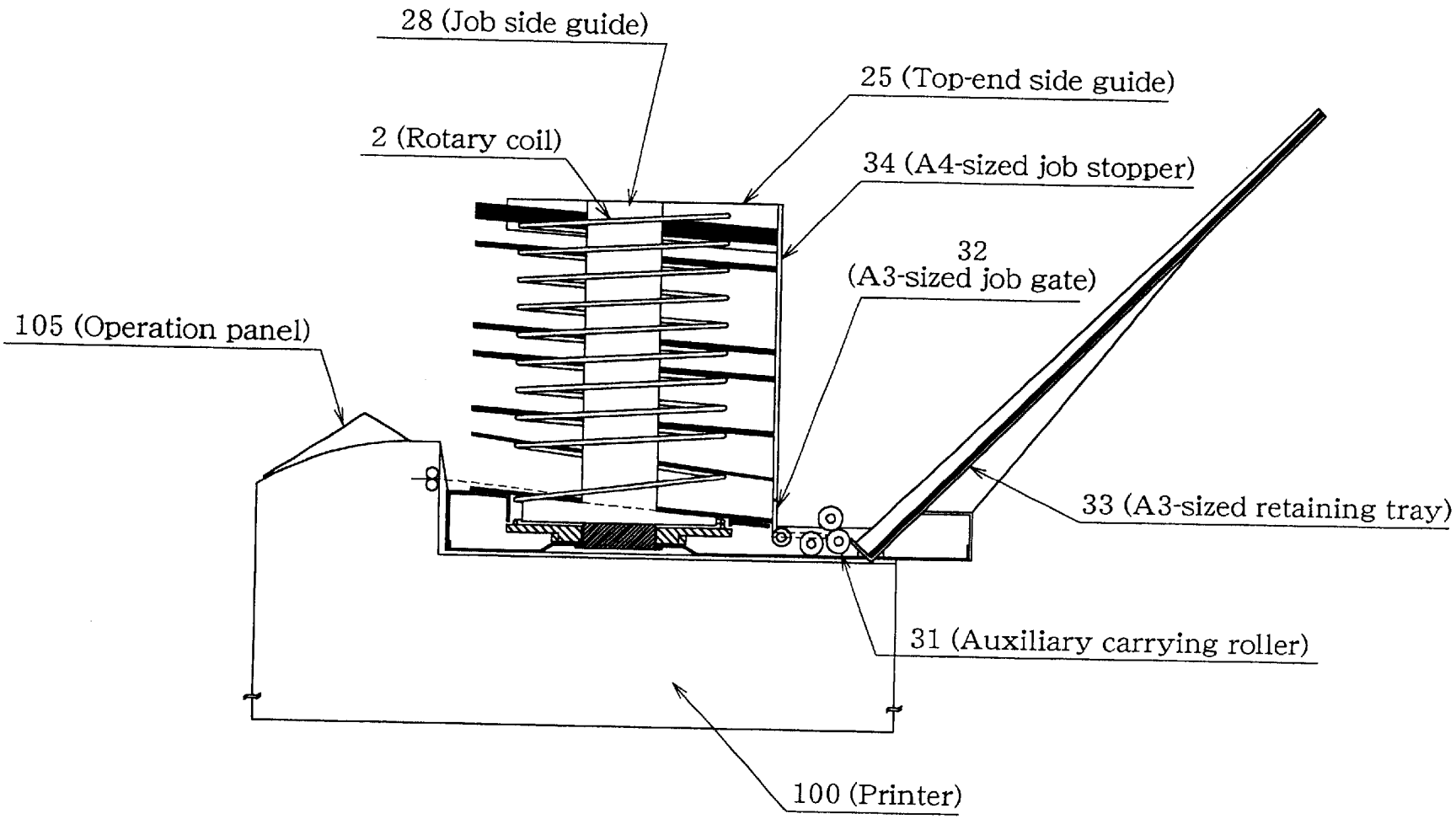
FIG. 10 is a side view of an embodiment where A3-sized jobs can be held by an auxiliary carrying roller.
Figure 11:
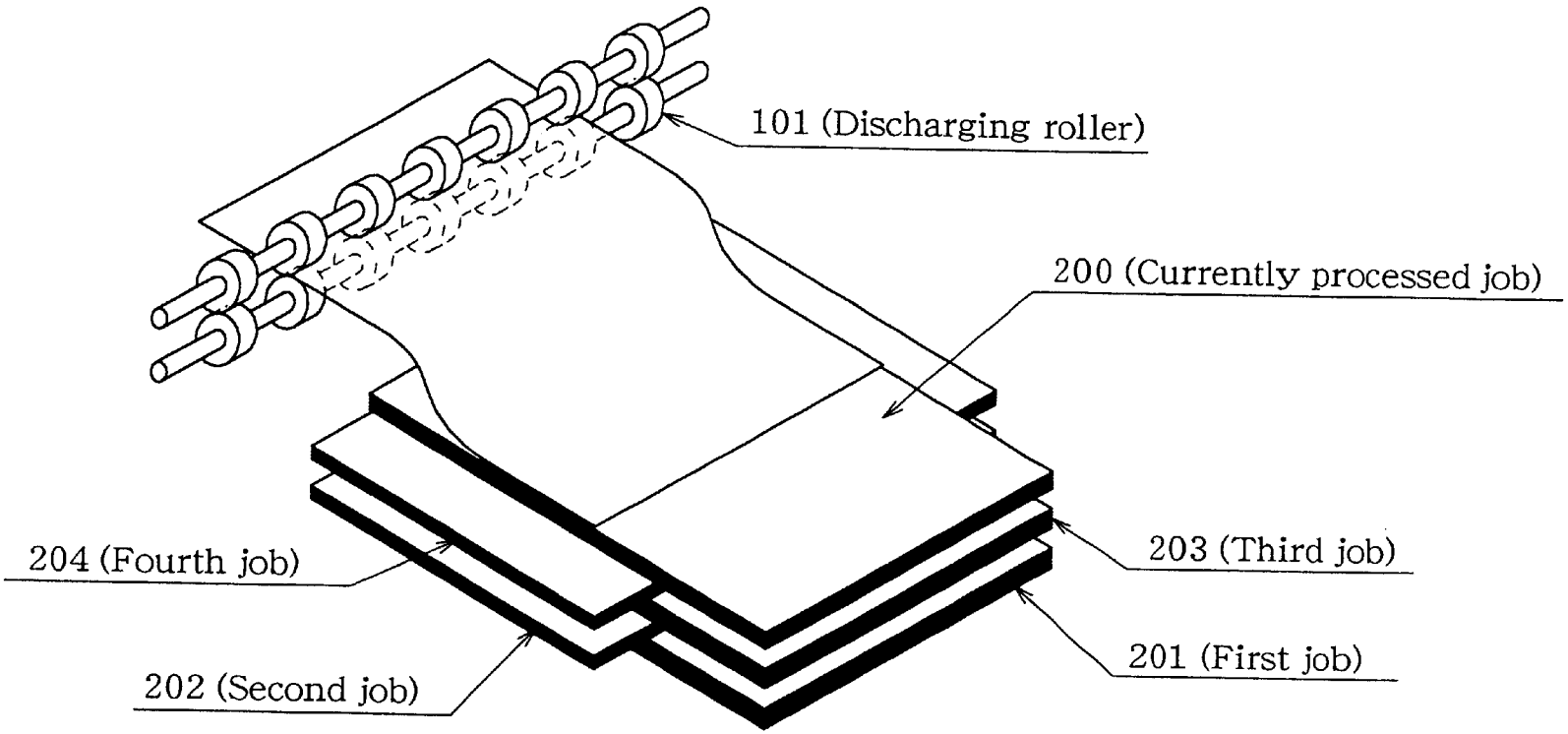
FIG. 11 is a general view showing function of a conventional post-printing processor in which jobs are separated by alternately switching the directions of stacks of sheets.
Figure 12:
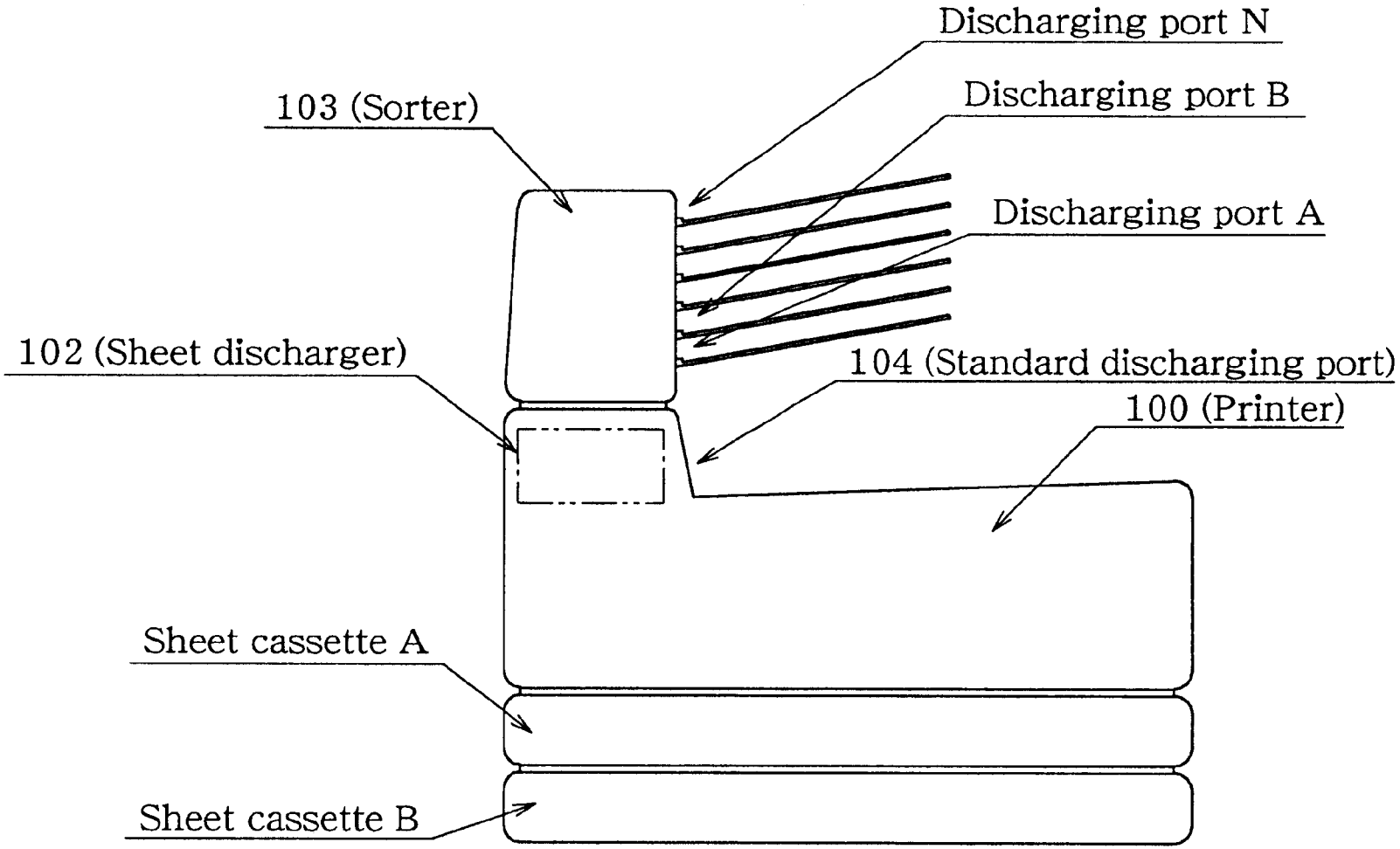
FIG. 12 is a general view showing function of a conventional post-printing processor in which jobs are separated by switching among the sheet-discharging ports by a sorter.

Since the post-printing processor adaptable to both A4- and A3-sized jobs does not exceed the outer dimensions of the printer 100, the installation area required for the post-printing processor is not larger than that required for the printer 100.

Where the embodiment shown in FIG. 9 is provided with the A4/A3-sized job gate mechanism to process both A4- and A3-sized jobs, another embodiment shown in FIG. 10 is provided with an auxiliary carrying roller 31 at the bottom position of the rotary coils 2 (the job inserting position) on the opposite side from the discharging port of the printer 100, as well as an A3-sized job gate 32 at the fore-end position of A4-sized sheets, which opens for A3-sized jobs and closes for A4-sized jobs at the job inserting position. The A3-sized job gate 32 has a simple structure unlike the embodiment shown in FIG. 6 that required the up-down movement mechanism, and may simply be provided at the job inserting position at the bottom of the rotary coils 2.

An A3-sized job retaining tray 33 may be provided beyond the auxiliary carrying roller 31 to hold A3-sized jobs by utilizing the step difference between the auxiliary carrying roller 31 and the A3-sized job retaining tray 33. Thus, A3-sized jobs are not held by the rotary coils 2, and in this case, the A4/A3-sized job gate mechanisms at each gap of the rotary coils 2 are not necessary and the rotary coils 2 can be reduced to two, thereby further reducing the installation cost. In both cases, the fore-end of an A3-sized sheet which is longer than an A4-sized sheet is picked by the auxiliary carrying roller 31 and sent to the A3-sized job retaining tray 33, whereas an A4-sized sheet is elevated by the rotary coils 2 while being stabled by an A4 stopper 34.

The positioning of the A3-sized job retaining tray 33 behind the processor is not limited to an oblique positioning as shown in the figure, and can be placed horizontal if there is enough space behind the processor. A plurality of carrying rollers (not shown) may be incorporated together with a conveying path (not shown) which elevates in vertical direction behind the printer 100 so that the jobs can be elevated to the uncollected job holding position at the top of the rotary coils 2.

Sheets smaller than A4-sized sheet may be used by providing an auxiliary conveying roller in the vicinity of the center of the top plate, so that smaller jobs can pass through the rotary coils not to be held by the coils. This has no problem since the output of jobs smaller than A4-sized jobs is extremely rare.

The post-printing processor for the printer according to the invention collectively holds print jobs discharged from the printer in separate gaps of spiral shape sheet-holding members. The spiral shape sheet-holding members are driven to make one or more full-turns to elevate each print job in the axial direction. Thus, the user can correctly find the boundary between the jobs and remove his/her job at once.

Since multiple sheet cassettes for altering the sheet discharging directions are not necessary, the printer structure can be simplified. In addition, the spiral shape sheet-holding members themselves have simple spiral structure. Accordingly, the post-printing processor can be produced less expensive.

The print jobs are clearly separated from each other at different pitches of the spiral shape sheet-holding members, and thus the contents of the print jobs can easily be confirmed. Even when the print job in the middle of other jobs is removed, the adjacent jobs are not commingled with each other and can distinctly be identified.

The print jobs left by the users are sent downstream to the end of the spiral shape sheet-holding members and accumulated there. Accordingly, continuous printing operations can be carried out for the entire mass of sheet stock, without impeding new printing operations.

Since the spiral shape sheet-holding members arranged at the sides of the sheet-discharging port are synchronously driven by the rotating mechanism, they can appropriately hold the sheets sent out from the sheet-discharging port of the printer, thereby ensuring stabile spiral shape sheet-holding.

Since the wound and rotating directions differ between the spiral shape sheet-holding members arranged at the right and left sides of the sheet-discharging port, friction on the sheet sent out from the sheet-discharging port can be compensated in right and left directions, thereby preventing transverse sliding of the sheet on the spiral shape sheet-holding members.

While unique identifying information generated for each print job is transmitted to the user via the network, the identifying information or user's name corresponding to the gap of the spiral shape sheet-holding members holding that print job is displayed on a print job holding result displaying member. Therefore, the user can easily collect his/her print job based on the identifying information or the user's name for his/her print job.

A plurality of regulating pieces for regulating the fore-ends of sheets sent out to the spiral shape sheet-holding members and a regulating piece positioning member for adjusting the position of each regulating piece according to the size of sheet are provided. Accordingly, the back-ends of the print jobs sent to the spiral shape sheet-holding members can be aligned in a uniform manner at a predetermined position regardless of the sizes of the sheets. As a result, print jobs of different sizes held in the gaps of the spiral can easily be collected regardless of their sizes.

Since the gap of the spiral shape sheet-holding members at the sheet-discharging port is formed relatively large, a print job can smoothly travel from the printer to the spiral shape sheet-holding members without being stuck. In addition, the completed print job can be positioned sufficiently far from the sheet-discharging port so that the newest print job can be removed without the sheets and the printer interfering with each other.

The post-printing processor can apply for letter size paper or double letter size paper which is popular in U.S.A.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims as therefore intended to be embraced therein.

The entire disclosure of Japanese Patent Application No. 2000-160715 (Filed on May $30^{th}$, 2000) including specification, claims, drawings and summary are incorporated herein by reference in its entirety.

What is claimed is:

1. A device for handling the output of a printer, said printer receiving requests for print jobs from a plurality of terminal devices via a network, said device comprising:

spiral shape sheet-holding members rotatably arranged to face a sheet-discharging port of the printer such that the center axes of the spiral shape sheet-holding members are generally perpendicular to a sheet conveying plane of the sheet-discharging port;

a rotating mechanism retaining the rotating positions of the spiral shape sheet-holding members such that openings of the gaps of the spiral shape sheet-holding members face the sheet-discharging port, and the rotating mechanism driving the spiral shape sheet-holding members to make one or more full-turns after a print job is completed; and a print job holding result displaying member displaying a relationship between identifying information unique to the print job received by the printer, and a sheet location on the spiral shape sheet-holding members.

2. The device according to claim 1, wherein the print job holding result displaying member comprises a plurality of display elements arranged in the axial direction of the spiral shape sheet-holding members at intervals corresponding to the number of full-turns made by the spiral shape sheet-holding members after completion of a print job.

3. A device for handling the output of a printer, said device comprising:

spiral shape sheet-holding members rotatably arranged to face a sheet-discharging port of the printer such that the center axes of the spiral shape sheet-holding members are generally perpendicular to a sheet conveying plane of the sheet-discharging port; and a rotating mechanism retaining the rotating positions of the spiral shape sheet-holding members such that openings of the gaps of the spiral shape sheet-holding members face the sheet-discharging port, and the rotating mechanism driving the spiral shape sheet-holding members to make one or more full-turns after a print job is completed; and a print job location displaying member that includes a plurality of identifying information displaying members respectively displaying identifiable markings, the displaying elements members being arranged in the axial direction of the spiral shape sheet-holding members at intervals corresponding to the number of full-turns made by the spiral shape sheet-holding members after every completion of a single print job, and wherein the identifying information displaying members display the identifying information of the print jobs in correspondence with the respective markings.

4. A device for handling the output of a printer, said printer receiving requests for print jobs from a plurality of terminal devices via a network, said device comprising:

spiral shape sheet-holding members rotatably arranged to face a sheet-discharging port of the printer such that the center axes of the spiral shape sheet-holding members are generally perpendicular to a sheet conveying plane of the sheet-discharging port;

a rotating mechanism retaining the rotating positions of the spiral shape sheet-holding members such that openings of the gaps of the spiral shape sheet-holding members face the sheet-discharging port, and the rotating mechanism driving the spiral shape sheet-holding members to make one or more full-turns after a print job is completed; and a plurality of identifiable markings arranged in the axial direction of the spiral shape sheet-holding members at intervals corresponding to the number of full-turns made by the spiral shape sheet-holding members after completion of a print job; and identifying information displaying members for displaying, in correspondence with the respective markings, the names of users of the terminal devices that have requested print jobs.

5. A device for handling the output of a printer, said device comprising:

spiral shape sheet-holding members rotatably arranged to face a sheet-discharging port of the printer such that the center axes of the spiral shape sheet-holding members are generally perpendicular to a sheet conveying plane of the sheet-discharging port;

a rotating mechanism retaining the rotating positions of the spiral shape sheet-holding members such that openings of the gaps of the spiral shape sheet-holding members face the sheet-discharging port, and the rotating mechanism driving the spiral shape sheet-holding members to make one or more full-turns after a print job is completed;

a plurality of regulating pieces regulating an end of a sheet sent to the spiral shape sheet-holding members; and a regulating piece driving member moving each of the regulating pieces in the axial direction of the spiral shape sheet-holding members synchronously with the sheet conveying rate, the sheet conveying rate being associated with the rotation of the spiral shape sheet-holding members.

* * * * *